United States Patent [19]

Kim

[11] 4,204,272

[45] May 20, 1980

[54] MINIATURE FLASHLIGHT UNIT

[76] Inventor: Sunyong P. Kim, 535 N. Cahuenga Blvd., Los Angeles, Calif. 90004

[21] Appl. No.: 941,039

[22] Filed: Sep. 11, 1978

[51] Int. Cl.[2] ..... F21L 7/00

[52] U.S. Cl. ..... 362/200; 362/311; 362/368

[58] Field of Search ..... 362/200, 201, 311, 368

[56] References Cited

U.S. PATENT DOCUMENTS 2,772,349 11/1956 Chamberlin ..... 362/201 X

*Primary Examiner*—Stephen J. Lechert, Jr.
*Attorney, Agent, or Firm*—John T. Matlago

[57] ABSTRACT

A miniature flashlight unit includes a housing having a flat back wall with outwardly extending semicircular top and bottom walls and an intermediate semicircular shelf so as to define a lower battery compartment and an upper light compartment. Easily assembled contact members provide for electrically connecting a pair of batteries enclosed in the battery compartment to a light bulb located in the light compartment. The light bulb is provided with a lens on the front face thereof which directs the light rays with a short focal length onto an area to be illuminated. Strips of foam adhesive tape are bonded to the rear surface of the flat back wall. The outer surfaces of the strips are covered with a liner which is only removed when the flashlight unit is to be permanently mounted on a wall or other flat surface.

7 Claims, 7 Drawing Figures

MINIATURE FLASHLIGHT UNIT

BACKGROUND OF THE INVENTION

This invention relates to illuminating devices and more particularly to a miniature flashlight unit.

There are many times when it is highly desirable to have a miniature flashlight unit handy for use where other light is not available such as when searching for items in a lady's handbag, placing a key in a lock at night, or when desiring to read a map at night, for example. Furthermore, it is desirable to be able to provide such a flashlight unit which in addition to being manually held, can be temporarily set in an upright position on a horizontal flat surface or can be permanently mounted with its back against a wall or similar flat surface.

Accordingly, one of the objects of the present invention is to provide a simply constructed miniature flashlight unit that is readily adapted for use where other light is not available.

Another object of the present invention is to provide simply fabricated and simply assembled contact members for electrically interconnecting a light bulb and a pair of batteries.

Another object of the present invention is to enclose a miniature flashlight unit in a housing having a flat rear surface to which strips of foam adhesive tape are secured for use in permanently mounting the housing on a flat surface when needed.

With these and other objects in view, the invention consists of the construction, arrangement and combination of the various parts of the device whereby the objects contemplated are attained as hereinafter more fully set forth, pointed out in the appended claims and illustrated in the accompanying drawings.

DRAWING SUMMARY

PREFERRED EMBODIMENT

Figure 1:
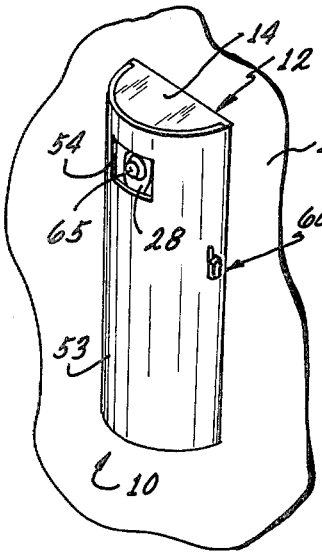
FIG. 1 is a front perspective view showing the miniature flashlight unit of the present invention mounted on a wall.
Figure 2:
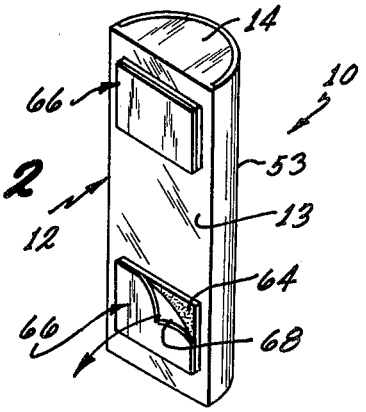
FIG. 2 is a back perspective view of the miniature flashlight unit of the present invention.

Referring to the drawings, a miniature flashlight unit 10 embodying the features of the present invention includes a plastic molded support member 12 comprised of a flat back wall 13 with integrally formed outwardly extending semicircular top and bottom walls 14 and 15 and an intermediate semicircular shelf 17 located nearer the top wall 14 so as to define a lower battery compartment 18 and an upper light compartment 19. The battery compartment is molded with two pair of clip-type projections 21 and 22 replacably holding respective miniature batteries 24 and 25 therein.

Figure 6:
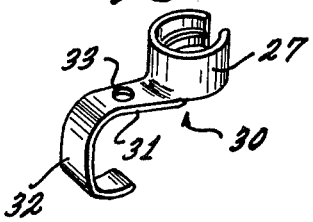
FIG. 6 is a perspective view of a contact member provided with a bulb holder.
Figure 4:
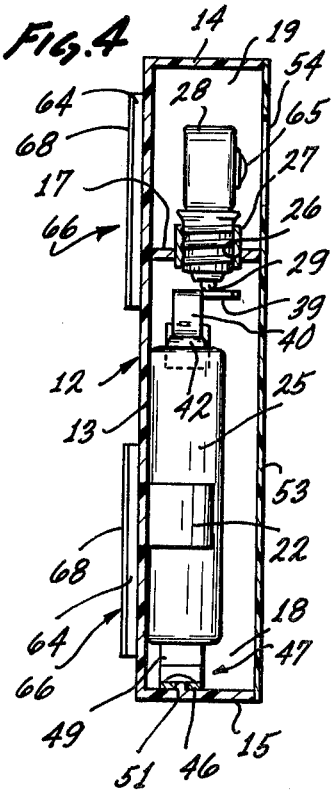
FIG. 4 is a vertical sectional view thereof as taken along line 4—4 of FIG. 3.
Figure 3:
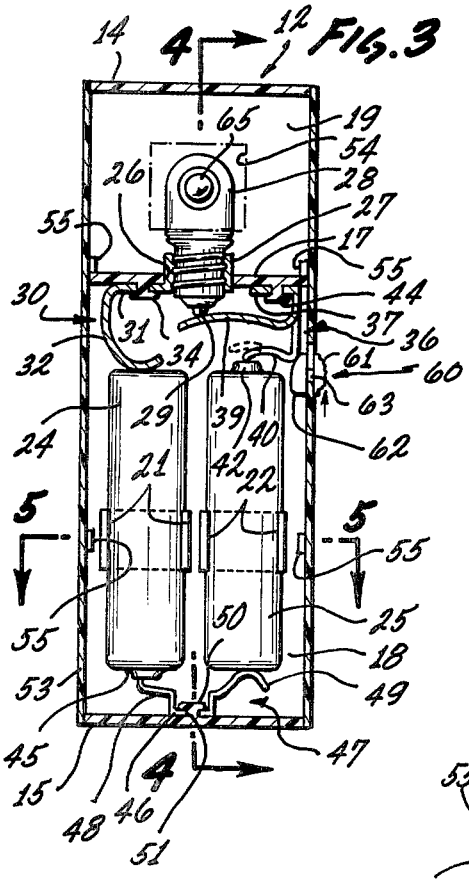
FIG. 3 is a front elevation view thereof with most of the front cover cut away.

The intermediate shelf 17 is provided with a central opening 26 for receiving the internally threaded bulb holder 27 of a first contact member 30. As illustrated in FIG. 6, this first contact member 30 integrally includes an outwardly extending mounting portion 31 disposed below the shelf on one side of the bulb holder 27 and a downwardly and inwardly extending spring strip contact portion 32 for contacting the upper end of the battery 24 stored on the same side of the battery compartment 18. The mounting portion 31 of contact member 20 is provided with a hole 33 which fits over a pin 34 molded on the underside of the shelf 17. Heat peening the end of pin 34 securely holds the first contact member 30 in position.

Figure 7:
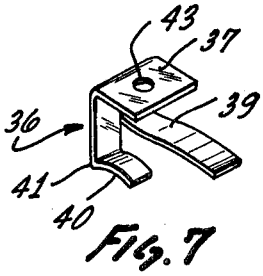
FIG. 7 is a perspective view of a contact member adapted to cooperate with an on-off sliding switch provided on the side of the front cover.

Located on the other side of the bulb holder 27 and below the shelf 17 is a second contact member 36. As illustrated in FIG. 7, the second contact member 36 integrally includes an outwardly extending mounting portion 37 disposed below the shelf 17 on the other side of the bulb holder 27 and an upper inwardly extending spring arm portion 39 for contacting the base terminal 29 of a miniature light bulb 28 disposed in the bulb holder 37. The second contact member 36 also integrally includes a lower offset inwardly extending spring arm portion 40 for contacting the terminal 42 on the top of the second battery 25.

It should be noted that the second contact member 36 may be formed of a rectangular sheet of spring material. As evident in FIG. 7, the top third of the sheet is permanently folded back at a right angle to form the mounting portion 37 and the remainder of the sheet is slit lengthwise in half to provide two elongated strip portions. One of these elongated strip portions is permanently bent back to form the upper spring strip portion 39 and the other of these elongated strip portions is permanently bent back further down its length to form the lower spring strip portion 40. The mounting portion 37 of the second contact member 36 is provided with a hole 43 which fits over a pin 44 molded on the underside of the shelf 17. The pin 44 is heat peened to hold the second contact member 36 securely in position.

A third contact member 47 is located on the bottom wall 15 of the support member 12. This third contact member 47 includes a mounting portion 46 with an upwardly extending spring arm portion 48 on one side thereof for contacting the terminal 45 of the battery 24 and another upwardly extending spring arm portion 49 on the other side thereof for contacting the bottom of the other battery 25. The third contact member 47 has a central hole 51 which fits over a pin 50 molded on the bottom wall 15. The pin 50 is heat peened to hold the third contact arm 47 securely in position.

Figure 5:
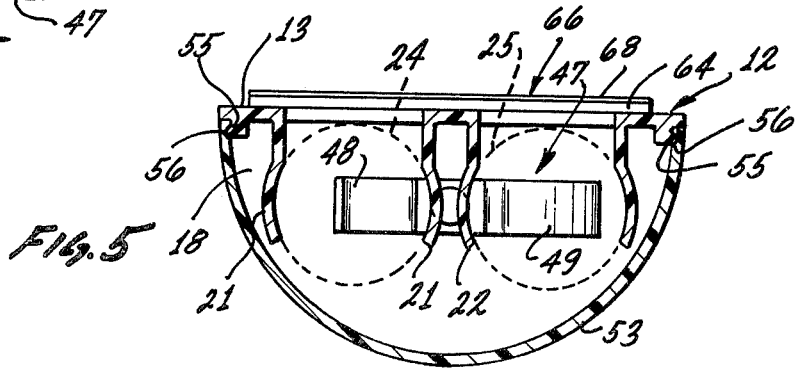
FIG. 5 is a transverse sectional view thereof as taken along line 5—5 of FIG. 3.

A plastic molded front cover 53 for the miniature flashlight unit 10 has a semicircular shape to engagingly fit over the peripheries of the semicircular top and bottom walls 14 and 15 and the semicircular intermediate shelf 17. The sides of the rear support member 12 are molded with ears 55 (FIG. 5) in the battery compartment 18 and just above the shelf 17 which snap into position in grooves 56 molded on the inner ends of the front cover 53 to retain the latter.

Located on the side of the front cover 53 is a switch 60 which includes an outer gripping member 61 and an inner wedge member 62 joined by an interconnecting member 63 which slides in a vertical slot formed on the side of front cover 53. When the outer gripping member 61 of the switch 60 is moved upwardly, the inner wedge member 62 engages the corner 41 of the low spring strip portion 40 of the second contact member 36 and forces it to be moved upwardly to the position shown in dotted lines to break the electrical circuit between the terminal 42 of battery 25 and the light bulb 28. Likewise, when the outer gripping member 61 is moved downwardly, the terminating end of the lower spring contact portion 40 is freed to contact the terminal 42 of the battery 25. The light bulb 28 is of the type that has a grounded lens 65 on the front face thereof. This lens 65 directs the light rays through the opening 54 in the upper section of the cover 53 to provide a desired intensity on the area to be illuminated. The rear of the light bulb 28 may be painted with an aluminum metal, for example, to help reflect the light rays forwardly. Note that the lens 65 serves to concentrate the light rays of the light bulb 28 into a directional beam having a desired cross sectional shape and sufficient intensity with a short focus so as to concentrate the available light on the area to be illuminated.

Disposed on the flat rear surface of the support member 21 are upper and lower strips 66 of commercially available foam adhesive material 64 which instantly bonds to the rear flat wall of the support member 12 when pressed thereagainst. Liners 68 normally cover the front and back surfaces of the strips 66. The liners 68 are removed from the inner surfaces of the strips 66 to enable them to be bonded in position on the back of the support member 12 during assembly of the flashlight unit 10. The liners 68 are retained on the outer surfaces of the upper and lower strips 66 until it is desired to mount the flashlight unit 10 on a flat surface of a wall 11, as illustrated in FIG. 1, or the flat flap of a lady's handbag or any other flat surface in the area where it is desired to permanently provide additional illuminating means. It should now be evident that the assembled miniature flashlight unit 10 is especially constructed so that it can be either removably positioned or permanently mounted in a dark area that it is found desirable to illuminate by use thereof.

While the invention has been concerned with a particular embodiment of the present invention, it is to be understood that many modifications and variations in the construction and arrangement thereof may be provided for without departing from the spirit and scope of the invention or sacrificing any of its advantages. The invention is therefore considered as including all such possible modifications and variations coming within the legitimate and valid scope of the claims.

What is claimed is:

1. A miniature flashlight unit comprising:

a molded support member having a rectangular flat back wall with outwardly extending flat top and bottom walls and an outwardly extending shelf intermediate said top and bottom walls for defining a light compartment and a battery compartment;

the back wall of said support member molded with two pairs of integrally formed clips extending outwardly therefrom for engaging a pair of batteries lying in parallel relationship in said battery compartment;

a first contact member having a bulb holder extending upwardly through a central opening in said shelf and a laterally extending mounting portion disposed below said shelf and including a spring strip portion extending downwardly and inwardly so as to engage the top of one of said batteries;

a bulb in said bulb holder;

a second contact member having a laterally extending mounting portion disposed below said shelf and including an upper laterally inwardly extending spring strip portion for engaging the base terminal of the bulb disposed in said bulb holder and a lower laterally inwardly extending spring strip portion for engaging the top of the other of said batteries;

a third contact member having a central mounting portion disposed in the bottom wall and having a first upwardly and outwardly extending spring strip portion on one side thereof contacting the bottom of one of said batteries and a second upwardly and outwardly extending spring strip portion on the other side thereof contacting the bottom of the other of said batteries;

said bulb disposed in said bulb holder having a relative flat face with an integrally formed lens thereon having a short focal length for directing the available light rays of the bulb onto a desired area to be illuminated; and a molded cover for fitting over and engaging the outer peripheries of the top and bottom walls and the intermediate shelf, said cover having an opening therein opposite the lens on the face of said bulb to permit the light rays thereof to pass therethrough to illuminate the area.

2. A miniature flashlight unit as claimed in claim 1 wherein said top and bottom walls and said intermediate shelf are semicircularly shaped, and wherein said cover is semicircularly shaped.

3. A miniature flashlight unit as claimed in claim 1 including a pin molded on the undersurface of each side of said shelf, said first and second contact members respectively having openings in their mounting portions for fitting over said pins, and said pins being heat peened to securely hold said first and second contact members in position below said shelf.

4. A miniature flashlight unit as claimed in claim 1 including at least one strip of foam adhesive bonded by one side thereof to the flat back surface of said back wall, the other of said side being covered by a readily removable liner.

5. A miniature flashlight unit as claimed in claim 1 wherein said second contact member is formed of a single sheet of spring material with the upper portion of said sheet folded back to form said mounting portion and with the remaining portion cut lengthwise to form two adjacent strip portions, one folded back to extend laterally inwardly to form said upper spring strip portion and the other folded back lower down its length to extend laterally inwardly to form said lower spring strip portion.

6. A miniature flashlight unit as claimed in claim 1 including a switch on the side of said cover, said switch including an outer gripping portion and an inner wedge portion coupled by an intermediate portion slideably in a slot on the side of said cover, said inner wedge portion located opposite the lower corner of the lower spring strip portion of said second contact member.

7. A miniature flashlight unit comprising:

a molded support member having a rectangular flat back wall with outwardly extending flat top and bottom walls and a shelf intermediate said top and bottom walls for defining a light compartment and a battery compartment;

a pair of batteries disposed in parallel relationship in said battery compartment;

a first contact member having a bulb holder extending through an opening in said shelf and a mounting portion disposed below said shelf and including a spring strip portion engaging the top of one of said batteries;

a bulb in said bulb holder, said bulb having an integrally formed lens on the face thereof;

a second contact member having a mounting portion disposed below said shelf and including a first spring strip portion for engaging the base terminal of the bulb and a second spring strip portion for engaging the top of the other of said batteries;

a third contact member having a mounting portion disposed on the bottom wall and having a first strip portion contacting the bottom of one of said batteries and a second strip portion contacting the bottom of the other of said batteries;

a molded cover for fitting over and engaging the outer peripheries of the top and bottom walls, said cover having an opening therein opposite the face of said bulb to permit the light rays to pass therethrough to illuminate the area; and a strip of foam adhesive on the flat back wall of said molded support member.

* * * * *